US008312996B2

(12) United States Patent
Bakula

(10) Patent No.: US 8,312,996 B2
(45) Date of Patent: Nov. 20, 2012

(54) VIBRATORY MATERIAL SCREEN WITH SEAL

(75) Inventor: John James Bakula, Grand Island, NY (US)

(73) Assignee: Derrick Corporation, Buffalo, NY (US)

( * ) Notice: Subject to any disclaimer, the term of this patent is extended or adjusted under 35 U.S.C. 154(b) by 89 days.

(21) Appl. No.: 11/040,212

(22) Filed: Jan. 21, 2005

(65) Prior Publication Data

US 2006/0163122 A1 Jul. 27, 2006

(51) Int. Cl.
*B07B 1/49* (2006.01)

(52) U.S. Cl. ..... 209/397; 209/392; 209/399; 209/401; 209/403

(58) Field of Classification Search ..... 209/395, 209/399, 401–405, 408
See application file for complete search history.

(56) References Cited

U.S. PATENT DOCUMENTS

| | | | | |
|---|---|---|---|---|
| 4,575,421 | A | 3/1986 | Derrick et al. | |
| 4,857,176 | A | 8/1989 | Derrick et al. | |
| 5,221,008 | A | 6/1993 | Derrick | |
| 5,332,101 | A | 7/1994 | Bakula | |
| 5,392,925 | A * | 2/1995 | Seyffert | 209/405 |
| 5,417,793 | A | 5/1995 | Bakula | |
| 5,417,858 | A | 5/1995 | Derrick et al. | |
| 5,417,859 | A | 5/1995 | Bakula | |
| 5,636,749 | A | 6/1997 | Wojciechowski | |
| 5,690,826 | A | 11/1997 | Cravello | |
| 5,851,393 | A | 12/1998 | Carr et al. | |
| 5,868,929 | A | 2/1999 | Derrick et al. | |
| 5,876,552 | A | 3/1999 | Bakula | |
| 5,931,310 | A * | 8/1999 | Duggan | 209/380 |
| 5,944,993 | A * | 8/1999 | Derrick et al. | 210/388 |
| 5,950,841 | A | 9/1999 | Knox et al. | |
| 5,958,236 | A | 9/1999 | Bakula | |
| 6,000,556 | A | 12/1999 | Bakula | |
| 6,053,332 | A | 4/2000 | Bakula | |
| 6,070,736 | A * | 6/2000 | Ballman et al. | 209/325 |
| 6,202,856 | B1 | 3/2001 | Carr | |
| 6,269,954 | B1 * | 8/2001 | Baltzer | 209/405 |
| 6,290,069 | B1 | 9/2001 | Schwartze et al. | |
| 6,340,089 | B1 * | 1/2002 | Bakula | 210/388 |
| 6,431,368 | B1 | 8/2002 | Carr | |
| 6,510,947 | B1 * | 1/2003 | Schulte et al. | 210/388 |
| 6,669,027 | B1 * | 12/2003 | Mooney et al. | 209/405 |
| 6,736,271 | B1 | 5/2004 | Hall | |
| 6,769,550 | B2 * | 8/2004 | Adams et al. | 209/399 |
| 6,789,680 | B2 * | 9/2004 | Ward et al. | 209/403 |
| 6,825,136 | B2 | 11/2004 | Cook et al. | |
| 6,845,868 | B1 | 1/2005 | Krush et al. | |
| 7,000,777 | B2 * | 2/2006 | Adams et al. | 209/399 |
| 2002/0000399 | A1 * | 1/2002 | Winkler et al. | 209/399 |
| 2002/0130064 | A1 * | 9/2002 | Adams et al. | 209/399 |
| 2003/0136710 | A1 * | 7/2003 | Adams et al. | 209/405 |
| 2004/0195155 | A1 * | 10/2004 | Mooney et al. | 209/399 |

OTHER PUBLICATIONS

Page from www.brandtvarco.com.

* cited by examiner

*Primary Examiner* — Terrell Matthews
(74) *Attorney, Agent, or Firm* — Jason P. Mueller; Adams and Reese LLP

(57) ABSTRACT

A screen assembly for separating solid materials of differing sizes in a material stream, having a support, and a screen arrangement placed upon the support, wherein the support has at least one seal placed on the support, the seal configured to interface with a mounting surface of a shaking apparatus.

27 Claims, 7 Drawing Sheets

VIBRATORY MATERIAL SCREEN WITH SEAL

FIELD OF THE INVENTION

The present invention relates to a screen assembly. More specifically, the present invention relates to a screen assembly which provides at least one seal on the mating surface between the screen assembly and a vibratory loading machine.

BACKGROUND INFORMATION

Vibratory separators are used to separate differing sizes of materials in a flowing material stream during processing at a manufacturing facility. These vibratory separators incorporate removable screen assemblies which perform the separation of the materials. The material stream is provided to the vibratory screen in various forms including both dry and wet states. The material stream is provided to the screen assemblies where it impinges upon the screen surface of the screen assembly. The screens are then moved (vibrated) to cause the solids which have impinged upon the screen to be separated according to the size of the holes in the screen, as required in the screening operation. Materials passing through the screen proceed to further processing. Materials not passing the screen (termed oversized) are then removed from the screen and may be discarded or returned to the material stream.

The conventional screens provided to the vibratory loading machines are simple wire mesh units placed upon a base provided by the vibratory loading machine. The vibratory loading machine is then activated and set to the amount of vibration needed. To help in the alignment of the screen upon the vibratory loading machine, the conventional screens are equipped with mating holes that accept a dowel (or special proprietary pin) protruding from the top of the vibratory loading machine. When the screens are required to be removed/repaired or discarded, the screen is lifted from the vibratory loading machine such that the pin or dowel inserted into the frame of the screen exits the hole, thereby freeing the screen for removal. The screens are then replaced during the maintenance activity. As described above, the placement of a vibratory screen upon a vibratory loading device is accomplished in a one step process. There are significant drawbacks, however, to this single step installation and removal process. The first drawback of the current conventional screens and methods to install these screens is that although manufacturers attempt to make the vibratory loading machines in standard shapes and configurations, variations in the production of the vibratory loading machines occur during manufacturing. Vibratory loading machines also come in different shapes and arrangements; therefore conventional screens which are placed upon the vibratory loading machines often do not have a proper fit upon the mating surface of the vibratory loading machine. If misalignment is severe, the placement of the pin or dowel in the mating holes provided in the screen cannot occur and the operators of the manufacturing facility must augment the screens to properly secure the screens. The augmentation of the screening arrangements can be costly for users of such screens and in extreme cases full-time personnel must be employed to change and\or augment screens to allow the manufacturing facility to continue the material segregation process. This augmentation must often occur when the screen needs to be changed, and therefore production may be hampered due to the need for augmentation. Additionally, screens currently in production are expensive to produce as the structural components are often cumbersome and awkward to produce.

Current vibratory screen arrangements have other significant drawbacks. In general, the vibratory screen arrangements are placed upon the mating surface of a vibratory loading machine. During operation of the vibratory loading machine, the vibratory screen arrangements move in a predefined manner which can include several degrees of freedom of motion. During movement of the screening arrangements, materials often shift onto and off of the arrangements. Current vibratory screen arrangements do not provide any sealing mechanism between the vibratory screening arrangement and the vibratory screening machine. This lack of any sealing mechanism or capability often causes detrimental effects on the screening process.

Materials can flow from the top of the screen arrangement and by pass the screen arrangement in the non sealed locations. Materials by passing the screen arrangement, therefore, may not be properly sized and materials in the material stream leaving the screen may not be within prescribed process limitations.

There is therefore a need to provide a screen arrangement which will be easy to install on a vibratory loading machine and that will not require workers at the manufacturing facility to augment the screen during installation.

There is also a need to provide a vibratory screen arrangement which can be placed upon different configurations of vibratory loading machines which will allow the vibratory loading machines to operate at expected efficiencies.

There is a yet further need for a vibratory screen arrangement which provides a seal between the vibratory screening arrangement and the vibratory loading machine such that materials cannot transfer through the screening arrangement without passing through the screening material.

There is also a further need to provide a vibratory screen arrangement which is economical to produce and which will have a long service life for the environment in which the screen is placed.

There is a further need to provide a vibratory screen arrangement which will function under different structural loading conditions without degrading from anticipated vibratory loading cycles.

SUMMARY

It is therefore an objective of the present invention to provide a screen arrangement which will be easy to install on a vibratory loading machine and that will not require workers at the manufacturing facility to augment the screen during installation.

It is also an objective of the present invention to provide a vibratory screen arrangement which may be placed upon vibratory loading machines having different configurations which will allow the vibratory loading machines to operate at expected efficiencies.

It is a still further objective of the present invention to provide a vibratory screen arrangement which has a seal between the vibratory screening arrangement and the vibratory loading machine such that materials cannot transfer through the screening arrangement without passing through the screening material.

It is also an objective of the present invention to provide a vibratory screen arrangement which is economical to produce and which will have a long service life for the environment in which the screen is placed.

It is a still further objective of the present invention to provide a vibratory screen arrangement which will function under different structural loading conditions without degrading from anticipated vibratory loading cycles.

The objectives of the present invention are achieved as illustrated and described. The present invention provides a screen assembly for separating solid materials of differing sizes in a material stream, the screen assembly comprising a support, and a screen arrangement placed upon the support; wherein the support has at least one seal placed on the support, the seal configured to interface with a mounting surface of a shaking apparatus.

Other configurations of the screen assembly are also considered part of the invention. These configurations include a seal placed between the support and the screen arrangement or a screen arrangement that is configured in a corrugated arrangement. The screen arrangement may be configured in a flat arrangement. The screen arrangement also may have a first member for interfacing with the support, the first member having holes for allowing materials to pass through the first member and a screening material placed upon the first member. Additionally, the seal placed between the support and the screen arrangement may be formed by epoxy placed between the support and the screen arrangement. The edges of the corrugations in the screen may be filled with epoxy. In addition to the above, the screen assembly for separating solid materials of differing sizes in a material stream may be configured wherein the at least one seal is partially countersunk into the support. Additionally, the screen assembly for separating solid materials of differing sizes in a material stream may be configured, wherein the seal is two seals placed at the approximate outside edge of the support. The screen assembly for separating solid materials of differing sizes in a material stream may also be configured of a plate section interfacing with the support, a coarse wire mesh material placed in contact with at least a part of the plate section, a plastic layer with holes arranged over the coarse wire mesh, and a fine wire mesh placed on top of the plastic layer. The screen assembly for separating solid materials of differing sizes in a material stream may also be made of a high density elastomeric material. Additionally, an entire periphery of an interface on the screen arrangement is configured with the at least one seal. The support is made of at least four sections of tube placed in a rectangle and the at least one seal is placed in a channel created in a tube of the rectangle. An additional configuration of the present invention is where the support contains at least two channels, with each of the at least two channels placed in a different tube and the two channels placed in a parallel direction. For all embodiments, the at least one seal may be a watertight seal. An additional configuration of the present invention is disclosed wherein a first of the two longitudinal supports connecting oppositely placed parallel tubes is placed at one third of a total width of the screen assembly and a second of the two longitudinal supports connecting oppositely placed parallel tubes is placed at two thirds of the total width of the screen assembly. The screen assembly for separating solid materials of differing sizes in a material stream may also have a first lateral support brace, and a second lateral support brace, the first and second lateral support braces connecting oppositely placed parallel tubes and parallel a placed first and second longitudinal supports. The first lateral support brace may be placed at approximately one third of a total length of the screen assembly and the second lateral support brace is placed at approximately two thirds of the total length of the screen assembly.

The current invention also provides a method of installing a vibratory screen arrangement onto a vibratory loading machine. The current invention provides for the steps of providing a vibratory screen arrangement with a seal on an interface surface, and placing the vibratory screen arrangement on a vibratory loading machine such that the vibratory screen arrangement is sealed to the vibratory loading machine, the vibratory screen arrangement configured to receive a material stream for processing.

DETAILED DESCRIPTION

Figure 1:
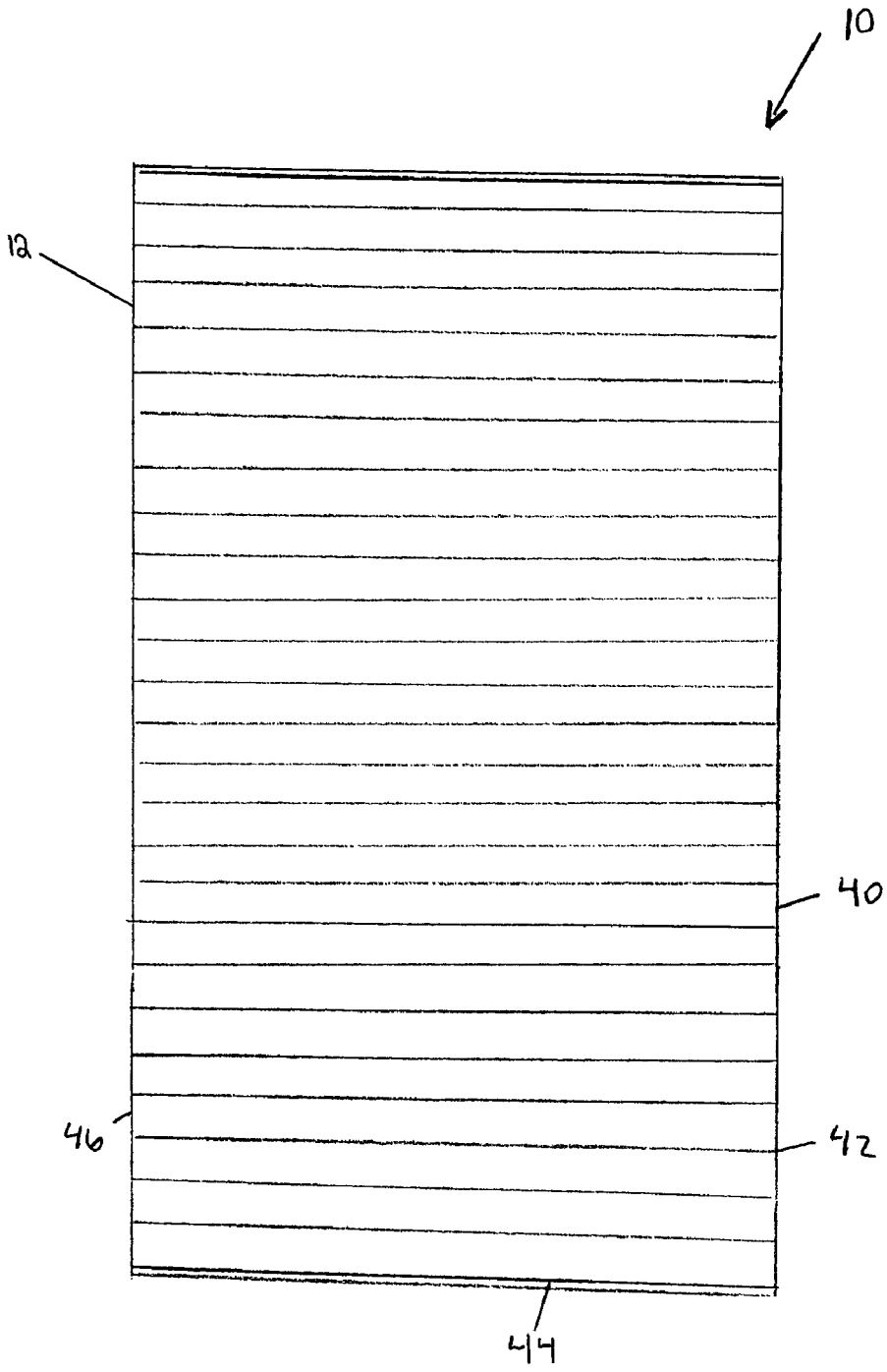
FIG. 1 is a top view of a vibratory screen in accordance with the present invention.

Referring to FIG. 1, a vibratory screen 10 is illustrated. The vibratory screen 10 is placed upon a vibratory loading machine such that a material stream that is placed upon the screen 10 is separated through a screen surface 40. The screen surface 40 is placed on the support 12 such that a desired amount of deflection is achieved when material is added to a top surface of the screen surface 40. In the illustrated embodiment provided in FIG. 1, the screen surface 40 is provided with a corrugated surface. The corrugated surface allows for an undulating screen surface that aids in separation of materials placed upon the screen surface 40. In FIG. 1, a total of 25 screen undulations 42 are provided on the surface of the vibratory screen 10. Other configurations are possible and therefore the number of screen undulations 42 provided in the vibratory screen 10 may be varied.

These configurations provided in FIG. 1 are therefore merely illustrative of other configurations that are included as part of the invention. The vibratory screen 10 provided in the present invention also has edge areas 44 placed along the periphery 46 of the vibratory screen 10. The edge areas 44 allow for a contact surface of the vibratory screen 10 onto a vibratory loading machine. The top sides of the edge areas 44 also provide a contact point between the individual sections of wire mesh (described later) to the support plate 50 of the vibratory screen 10. The connection of the wire mesh to the edge areas 44 is performed through placement of an epoxy adhesive in the edge areas 44 to provide a secure bond between the individual components.

Figure 2:
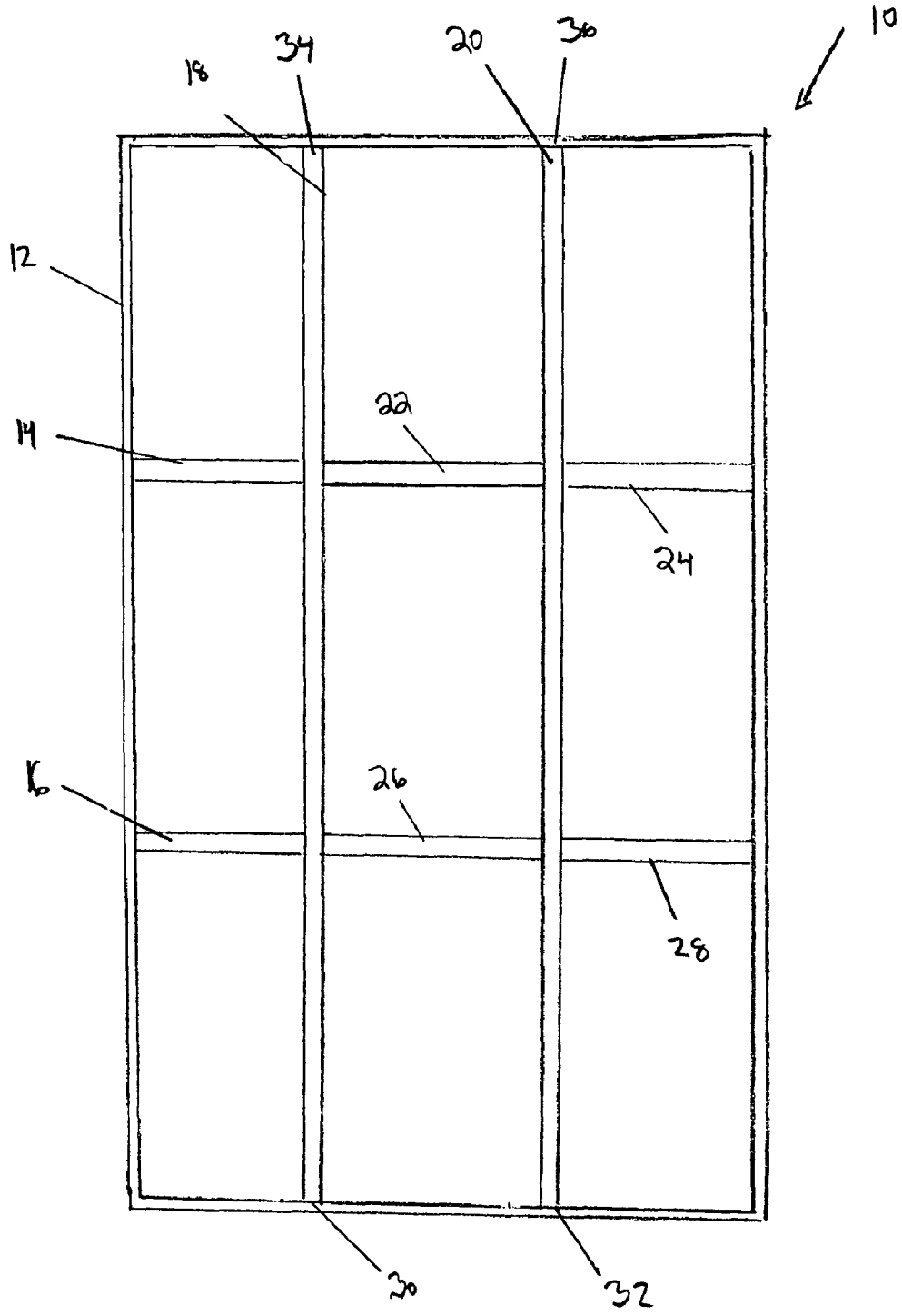
FIG. 2 is a bottom view of the vibratory screen illustrated in FIG. 1.

Referring to FIG. 2, a bottom side of the vibratory screen 10 is illustrated. The bottom side of the vibratory screen 10 is provided with an exterior perimeter frame 12 that provides the mating surface upon which the vibratory screen 10 is placed on a vibratory loading device. The vibratory screen 10 also has two lateral supports 14, 16 and first and second longitudinal supports 18, 20. The connection between the first lateral support 14 and the support 12 as well as the second lateral support 16 and the support 12 is through a welded connection. The first lateral support 14 is comprised of three sections, namely a first section, a middle section 22 and an end section 24. The second lateral support is also comprised of a first section, a middle section 26 and an end section 28.

The first longitudinal support 18 traverses an entire length of the vibratory screen 10. The first longitudinal support 18 is connected to the frame 12 at a bottom connection 30 and a third connection 34. The second longitudinal support 20 is connected to the support 12 at a second bottom connection 32 and a first connection 36. In the illustrated embodiment, the first lateral support 14, the second lateral support 16, the first longitudinal support 18 and the second longitudinal support 20 are made of tubular steel with welded interconnections between the individual support members. The tubular steel is designed to have a thickness which will limit the overall deflection of the vibratory screen 10 during all structural loading conditions. The support 12 as well as the first longitudinal support 18, the second longitudinal support 16, the first lateral support 14 and the second lateral support 18 are all coated with a coating which will limit or eliminate the amount of corrosion on the individual support members. A non limiting example of the coating includes Polyamide Epoxy such as Epolon II Rust Inhibitive Epoxy Primer and finish coat by Sherwin Williams Company although as acrylic and polyurethane systems may be used as well.

Figure 3:
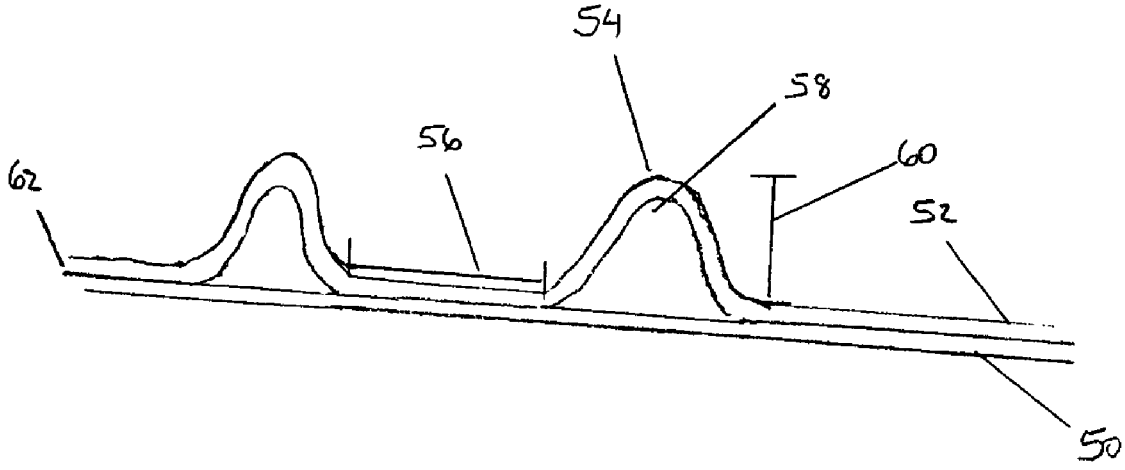
FIG. 3 is a side view of a wire mesh arrangement placed upon a support plate of the vibratory screen in accordance with FIG. 1.

Referring to FIG. 3, a side view of the material used for screening is illustrated. Each of the corrugations is provided with a height 60 which ends in a peak 54. At sections of the wire mesh that are not elevated, an open space 56 is provided. The open space 56 determines the amount of spacing in between individual peaks 54 along the length of the vibratory screen 10. The peaks 54, as well as the open space 56, are comprised of a wire mesh 52 that is placed in the arrangement illustrated. Underneath the wire mesh 52, a plate 50 is provided as a structural reinforcement of the wire mesh arrangement. The wire mesh arrangement continues until it reaches an edge area 62. At the edge areas 62, the wire mesh 52 is attached to the support 12 by the previously mentioned epoxy adhesive in the edge areas 44 of the support 12. In the sections of the wire mesh arrangement where there is a peak 54, an opening 58 is provided due to the bending of the wire mesh 52 away from the plate 50. In the opening 58, epoxy is used to further provide structural support of the peak areas 54 of the wire mesh arrangement and to prevent any channels from developing which would allow material to freely flow through the wire mesh arrangement without passing through screening material. The epoxy used to fill the opening 58 in the wire mesh areas is a high temperature high strength epoxy that will not degrade under abrasive conditions. The epoxy adhesive may also be colored to match the coating provided on the support 12 to allow an overall seamless appearance.

Figure 4:
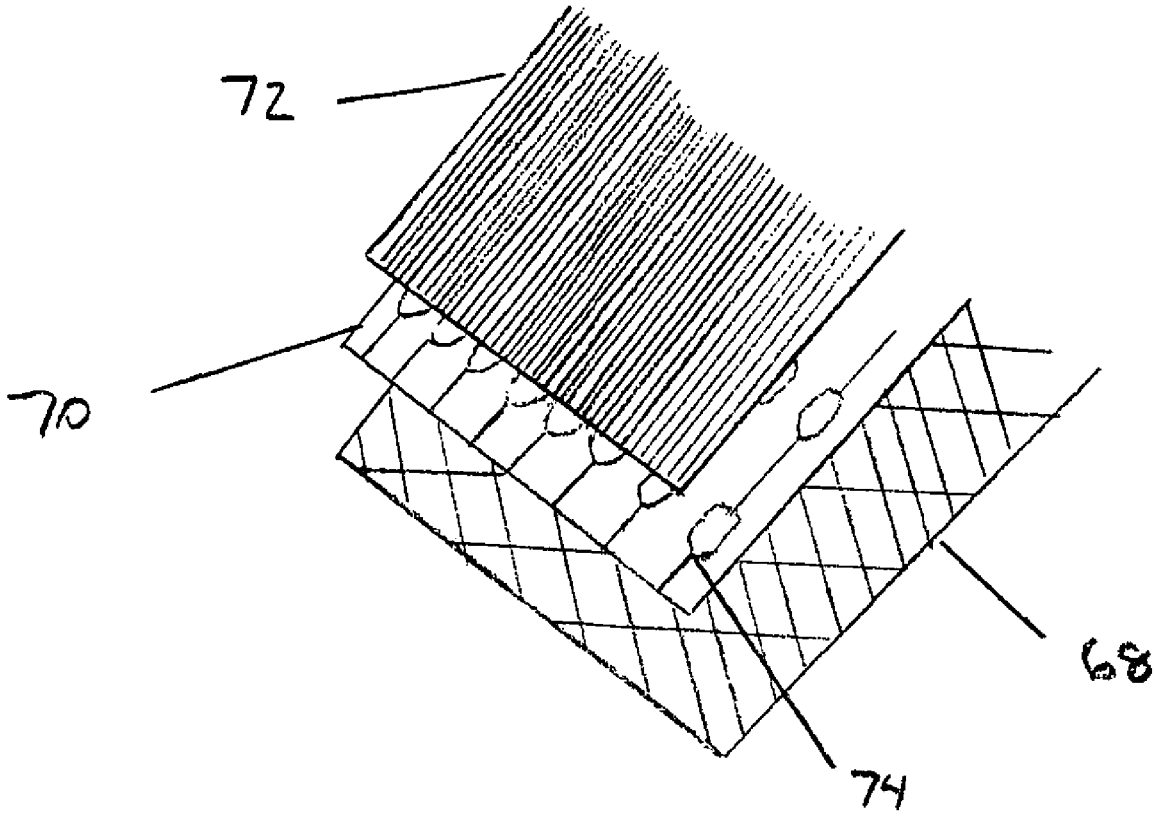
FIG. 4 is an exploded view of the wire mesh arrangement showing the constituent parts of the arrangement.

Referring to FIG. 4, the overall wire mesh arrangement provided in FIG. 3 (denoted as element 52) is more closely illustrated. The wire mesh 52 is comprised of a coarse wire mesh 68 onto which a plastic film 70 and a fine wire mesh 72 are installed. In the illustrated embodiment provided in FIG. 4, the coarse wire mesh 68 is placed on a bottom of the configuration and has approximately 15 openings per square inch. The plastic film 70 is placed over the coarse wire mesh 68. The plastic film 70 has in integral support structure 74 placed in the core of the film 70. The integral support structure 74 allows the film 70 to withstand structural loading without tearing. The plastic film 70 incorporates holes in the film 70 to allow materials of a specified size to flow through. Over the plastic film 70 a fine wire mesh 72 is provided. The fine wire mesh 72 allows for additional separation of the material stream placed upon the overall wire mesh arrangement. Multiple layers of fine wire mesh 72 may be used throughout all embodiments illustrated and described.

Figure 5:
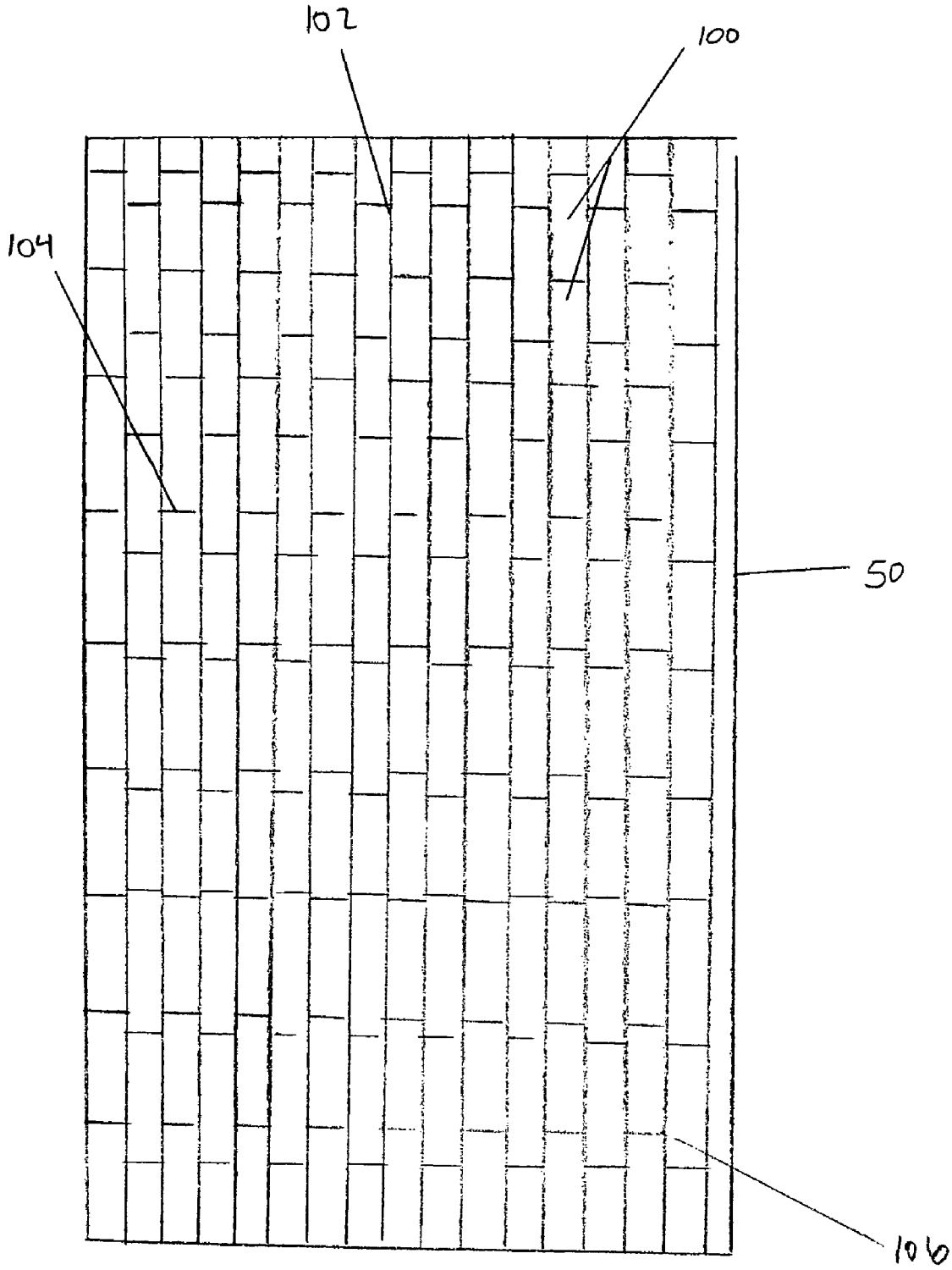
FIG. 5 is a plan view of a support plate of the vibratory screen illustrated in FIG. 1.

Referring to FIG. 5, a planar view of the support plate 50 is illustrated. The support plate 50 allows the wire arrangement 52 to be placed upon a top surface 106. The support plate 50 provides structural reinforcement of the wire arrangement 52 under loading conditions that will be experienced by the overall forces imparted by the vibratory loading and material stream placed upon the wire arrangement 52. The support plate 50 is made of a non corrosive metallic material, such as stainless steel. The exterior surfaces of the support plate are coated with a non corrosive coating which matches the exterior coatings applied to the other surfaces of the vibratory screen 10, thereby providing a non-corrosive structure.

Figure 6:
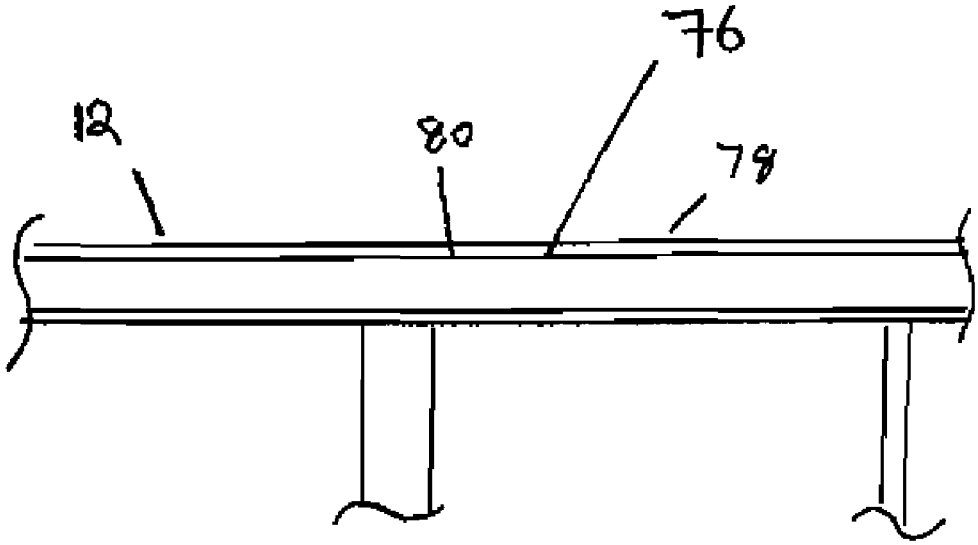
FIG. 6 is a plan view of the support of vibratory screen illustrated in FIG. 1, wherein the seal is detailed.
Figure 7:
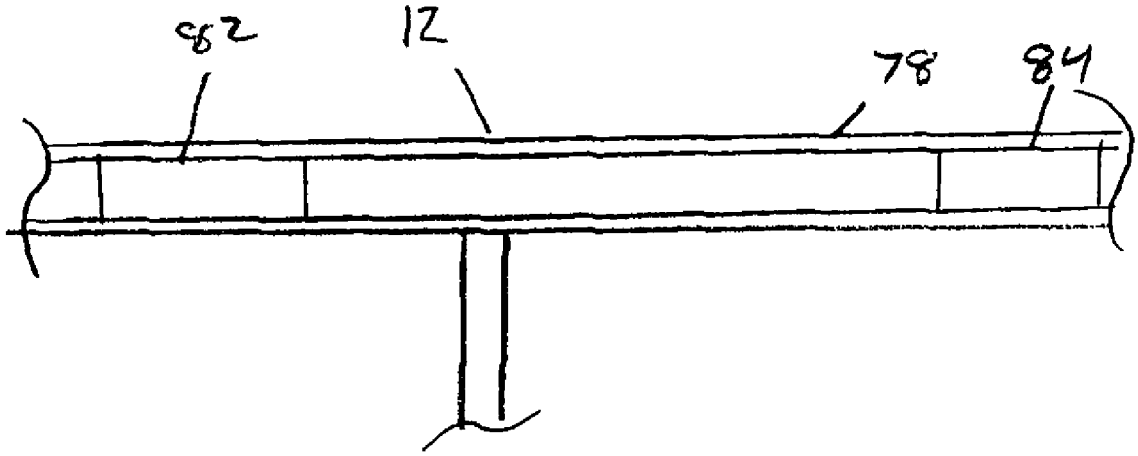
FIG. 7 is a plan view of an alternative embodiment of the vibratory screen providing a dual seal design.

Referring to FIG. 6, an expanded view of a member 78 of the support 12 is illustrated. The member 78 of the support 12 is configured with a channel 76 which has removed the material placed within this volume. A seal 80 is placed within the channel 76 such that the seal 80 contacts in an exterior edge of the vibratory loading machine. The seal 80 is configured to provide a watertight connection between the vibratory screen 10 and the vibratory loading machine. The seal is made of elastomeric material, such as neoprene or high density foam. In the illustrated embodiment provided in FIG. 6, the elastomeric material which constitutes the entire seal extends an entire length of a side of the support 12. In the illustrated embodiment, two seals are provided on the vibratory screen 10. Although shown as a single piece of elastomeric material placed inside a channel formed in the support 12, the elastomeric material may be provided in a redundant configuration wherein multiple pieces of elastomeric material are incorporated into the support 12. Other configurations are possible, wherein as provided in FIG. 7, two individual seals 82, 84 are placed on a side of the support 78. The two individual seals 82, 84 provide two contact points upon which vibratory screen 10 contacts the vibratory loading machine.

The present invention provides a screen arrangement is easily installable by field workers onto to vibratory loading machine. The present invention provides a simple and efficient method to install and remove a screen arrangement while eliminating the need for augmenting the screen arrangement during installation. The vibratory screen arrangement can be placed upon vibratory loading machines having different configurations. The easy adaptability of the screen arrangement allows for a wide use of the screening function over a selection of machines. Although the screen arrangement may be adapted to be placed on different vibratory loading machines, the screen arrangement allows the vibratory loading machines to operate at expected efficiencies.

The present invention also provides a seal between the vibratory screening arrangement and the vibratory loading machine such that materials cannot transfer through the screening arrangement without passing through the screening material. This allows all material from the material stream to be processed, yielding processed material streams in conformance with expected parameters. The present invention also provides a vibratory screen arrangement which is economical to produce and which will have a long service life for the environment in which the screen is placed. The present invention also provides a vibratory screen arrangement which functions under different structural loading conditions without degrading from anticipated vibratory loading cycles.

The current invention also provides a method of installing a vibratory screen arrangement onto a vibratory loading machine. The method includes the first step of providing a vibratory screen arrangement with a seal on an interface surface. The next method step entails placing the vibratory screen arrangement on a vibratory loading machine such that the vibratory screen arrangement is sealed to the vibratory loading machine, the vibratory screen arrangement configured to receive a material stream for processing. During the installation step, several vibratory screen arrangements may be used concurrently such that a large open area of the vibratory loading machine can be covered by multiple vibratory screens placed in a planar configuration. The vibratory screens may be installed such that the overall arrangement of the vibratory screens presents a "dished" configuration. The individual vibratory screens may be placed upon a support system provided by the vibratory loading machine. Interconnection of the individual vibratory screens can be attained through connecting the sides of the individual supports of the vibratory screen arrangements or the vibratory screen arrangements may be installed in a friction connection arrangement. The friction connection established between interfacing sides of the vibratory screen arrangements maintains the vibratory screen in a desired configuration. The overall configuration of the vibratory screens is such that each individual screen may be subjected to a 7 g force without significant detrimental impact upon the capability of the vibratory screen arrangement.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than in a restrictive sense.

What is claimed is:

1. A screen assembly for separating solid materials of differing sizes in a material stream, comprising:

a support having a top surface and a bottom surface;

a seal secured to the bottom surface of the support; and a screen arrangement placed upon the top surface of the support, the screen arrangement including a plate and a screen, the screen attached to an upper surface of the plate;

wherein the seal interfaces with a mounting surface of a shaking apparatus and provides a sealed connection between the screen assembly and the shaking apparatus;

wherein the seal is embedded at least partially in the support.

2. The screen assembly for separating solid materials of differing sizes in a material stream according to claim 1, wherein the screen is configured in a corrugated arrangement.

3. The screen assembly for separating solid materials of differing sizes in a material stream according to claim 1, wherein the screen is configured in a flat configuration.

4. The screen assembly for separating solid materials of differing sizes in a material stream according to claim 1, wherein the plate is metal.

5. The screen assembly for separating solid materials of differing sizes in a material stream according to claim 1, wherein an epoxy is placed between the support and the screen arrangement, the epoxy forming a sealed connection between the support and the screen arrangement.

6. The screen assembly for separating solid materials of differing sizes in a material stream according to claim 2, wherein the screen includes edge portions that are filled with epoxy.

7. The screen assembly for separating solid materials of differing sizes in a material stream according to claim 1, wherein the bottom surface includes a channel and the seal is located within the channel.

8. A screen assembly for separating solid materials of differing sizes in a material stream, comprising:

a support having a top surface and a bottom surface;

a seal secured to the bottom surface of the support; and a screen arrangement placed upon the top surface of the support, the screen arrangement including a plate and a screen, the screen attached to an upper surface of the plate;

wherein the seal interfaces with a mounting surface of a shaking apparatus and provides a sealed connection between the screen assembly and the shaking apparatus, wherein the seal is countersunk into the support.

9. The screen assembly for separating solid materials of differing sizes in a material stream according to claim 1, further comprising a second seal, the seal and the second seal located at an outside edge surface of the support.

10. The screen assembly for separating solid materials of differing sizes in a material stream according to claim 1, wherein the screen arrangement includes a coarse wire mesh material placed in contact with at least a part of the plate, a plastic layer with holes arranged over the coarse wire mesh, and at least one fine wire mesh placed on top of the plastic layer.

11. The screen assembly for separating solid materials of differing sizes in a material stream according to claim 10, wherein the screen arrangement includes corrugations.

12. The screen assembly for separating solid materials of differing sizes in a material stream according to claim 11, wherein the screen includes edge portions that are filled with epoxy.

13. The screen assembly for separating solid materials of differing sizes in a material stream according to claim 1, wherein the seal comprises a high density elastomeric material.

14. The screen assembly for separating solid materials of differing sizes in a material stream according to claim 1, wherein the seal is provided along an entire periphery of the support.

15. The screen assembly for separating solid materials of differing sizes in a material stream according to claim 10, wherein the plastic layer with holes and the fine wire mesh are attached to the plate with an epoxy layer at least two ends of the screen.

16. The screen assembly for separating solid materials of differing sizes in a material stream according to claim 1, wherein the support includes at least four sections of tube placed in a rectangle.

17. The screen assembly for separating solid materials of differing sizes in a material stream according to claim 16, wherein the at least four sections of tube include a channel and the seal is located in the channel.

18. The screen assembly for separating solid materials of differing sizes in a material stream according to claim 16, wherein the support contains at least two channels, each of the at least two channels.

19. The screen assembly for separating solid materials of differing sizes in a material stream according to claim 18, wherein the at least two channels are placed in a parallel direction.

20. The screen assembly for separating solid materials of differing sizes in a material stream according to claim 1, wherein the seal is watertight.

21. The screen assembly for separating solid materials of differing sizes in a material stream according to claim 1, wherein the support includes four tubes arranged in a rectangular arrangement and two longitudinal supports, each of the two longitudinal supports connecting oppositely placed parallel tubes.

22. The screen assembly for separating solid materials of differing sizes in a material stream according to claim 21, wherein a first of the two longitudinal supports connecting oppositely placed parallel tubes is placed at one third of a total width of the screen assembly and a second of the two longitudinal supports connecting oppositely placed parallel tubes is placed at two thirds of the total width of the screen assembly.

23. The screen assembly for separating solid materials of differing sizes in a material stream according to claim 22, further comprising:

a first lateral support brace; and a second lateral support brace, the first and second lateral support braces connecting oppositely placed parallel tubes and parallel placed first and second longitudinal supports.

24. The screen assembly for separating solid materials of differing sizes in a material stream according to claim 23, wherein the first lateral support brace is placed at approximately one third of a total length of the screen assembly and the second lateral support brace is placed at approximately two thirds of the total length of the screen assembly.

25. The screen assembly for separating solid materials of differing sizes in a material stream according to claim 10, wherein the plastic layer has internal supports configured to prevent ripping of the plastic layer.

26. A screen assembly, comprising: a screen arrangement, a support; and a seal, the screen arrangement arranged on an top surface of the support and including a screening surface, the seal arranged on a bottom surface of the support, is configured to interface with a mounting surface of a shaking apparatus, wherein the seal interfaces with a mounting surface of a shaking apparatus and provides a sealed connection between the screen assembly and the shaking apparatus, wherein the seal is embedded at least partially in the support.

27. The screen assembly of claim 26, wherein the screen arrangement includes a plate that interfaces with the top surface of the support and at least two layers of screening material.

* * * * *